US009047774B2

(12) United States Patent
Tseng et al.

(10) Patent No.: US 9,047,774 B2
(45) Date of Patent: Jun. 2, 2015

(54) METHOD AND APPARATUS FOR CROWD-SOURCED TRAFFIC REPORTING

(71) Applicant: Ford Global Technologies, LLC, Dearborn, MI (US)

(72) Inventors: Fling Tseng, Ann Arbor, MI (US); Kwaku O. Prakah-Asante, Commerce Township, MI (US); Dimitar Petrov Filev, Novi, MI (US); Shane Elwart, Ypsilanti, MI (US); Jianbo Lu, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 231 days.

(21) Appl. No.: 13/795,032

(22) Filed: Mar. 12, 2013

(65) Prior Publication Data

US 2014/0266795 A1 Sep. 18, 2014

(51) Int. Cl.

| | |
|---|---|
| ***G08B 21/00*** | (2006.01) |
| ***G08G 1/0967*** | (2006.01) |
| ***G08G 1/01*** | (2006.01) |

(52) U.S. Cl.
CPC ..... *G08G 1/096766* (2013.01); *G08G 1/0112* (2013.01)

(58) Field of Classification Search
USPC ..... 340/901, 902, 903, 904, 905; 701/23, 701/24, 117, 410
See application file for complete search history.

(56) References Cited

U.S. PATENT DOCUMENTS

| | | | |
|---|---|---|---|
| 4,937,751 | A | 6/1990 | Nimura et al. |
| 5,177,685 | A | 1/1993 | Davis et al. |
| 5,220,507 | A | 6/1993 | Kirson |
| 5,275,474 | A | 1/1994 | Chin et al. |
| 5,291,412 | A | 3/1994 | Tamai et al. |
| 5,351,779 | A | 10/1994 | Yamashita |
| 5,394,332 | A | 2/1995 | Kuwahara et al. |
| 5,406,491 | A | 4/1995 | Lima |
| 5,406,492 | A | 4/1995 | Suzuki |
| 5,487,002 | A | 1/1996 | Diller et al. |
| 5,578,748 | A | 11/1996 | Brehob et al. |
| 5,742,922 | A | 4/1998 | Kim |
| 5,767,795 | A | 6/1998 | Schaphorst |

(Continued)

FOREIGN PATENT DOCUMENTS

| | | |
|---|---|---|
| CN | 1573296 | 2/2005 |
| DE | 102005029744 | 12/2006 |

(Continued)

OTHER PUBLICATIONS

International Searching Authority, International Search Report and the Written Opinion for the corresponding PCT Application No. PCT/US2009/69668 mailed Mar. 4, 2010.

(Continued)

*Primary Examiner* — Jeffery Hofsass

(74) *Attorney, Agent, or Firm* — Jennifer M. Stec; Brooks Kushman P.C.

(57) ABSTRACT

A system includes a processor configured to project monitoring needs for a road segment. The processor is further configured to contact one or more vehicles traveling on the road segment during a time of monitoring need. The processor is additionally configured to instruct a first number, determined based on a projected monitoring need, of contacted vehicles to being monitoring and reporting traffic data for the road segment.

12 Claims, 5 Drawing Sheets

(56) References Cited

U.S. PATENT DOCUMENTS

| | | | |
|---|---|---|---|
| 5,790,973 | A | 8/1998 | Blaker et al. |
| 5,802,492 | A | 9/1998 | DeLorme et al. |
| 5,848,364 | A | 12/1998 | Ohashi |
| 5,901,806 | A | 5/1999 | Takahashi |
| 6,005,494 | A | 12/1999 | Schramm |
| 6,028,537 | A | 2/2000 | Suman et al. |
| 6,101,443 | A | 8/2000 | Kato et al. |
| 6,314,369 | B1 | 11/2001 | Ito et al. |
| 6,374,177 | B1 | 4/2002 | Lee et al. |
| 6,401,034 | B1 | 6/2002 | Kaplan et al. |
| 6,424,363 | B1 | 7/2002 | Matsuba et al. |
| 6,424,888 | B1 | 7/2002 | Sone et al. |
| 6,427,115 | B1 | 7/2002 | Sekiyama |
| 6,427,117 | B1 | 7/2002 | Ito et al. |
| 6,462,676 | B1 | 10/2002 | Koizumi |
| 6,484,092 | B2 | 11/2002 | Seibel |
| 6,484,093 | B1 | 11/2002 | Ito et al. |
| 6,487,477 | B1 | 11/2002 | Woestman et al. |
| 6,532,372 | B1 | 3/2003 | Hwang |
| 6,533,367 | B1 | 3/2003 | Latarnik et al. |
| 6,574,538 | B2 | 6/2003 | Sasaki |
| 6,574,551 | B1 | 6/2003 | Maxwell et al. |
| 6,608,887 | B1 | 8/2003 | Reksten et al. |
| 6,691,025 | B2 | 2/2004 | Reimer |
| 6,791,471 | B2 | 9/2004 | Wehner et al. |
| 6,829,529 | B2 | 12/2004 | Trefzer et al. |
| 6,834,229 | B2 | 12/2004 | Rafiah et al. |
| 6,866,349 | B2 | 3/2005 | Sauter et al. |
| 6,904,362 | B2 | 6/2005 | Nakashima et al. |
| 6,999,779 | B1 | 2/2006 | Hashimoto |
| 7,053,866 | B1 | 5/2006 | Mimran |
| 7,082,443 | B1 | 7/2006 | Ashby |
| 7,089,110 | B2 | 8/2006 | Pechatnikov et al. |
| 7,113,107 | B2 | 9/2006 | Taylor |
| 7,167,799 | B1 | 1/2007 | Dolgov et al. |
| 7,243,134 | B2 | 7/2007 | Bruner et al. |
| 7,286,931 | B2 | 10/2007 | Kawasaki |
| 7,315,259 | B2 | 1/2008 | Sacks |
| 7,369,938 | B2 | 5/2008 | Scholl |
| 7,421,334 | B2 | 9/2008 | Dahlgren et al. |
| 7,486,199 | B2 | 2/2009 | Tengler et al. |
| 7,571,042 | B2 | 8/2009 | Taylor et al. |
| 7,626,490 | B2 | 12/2009 | Kashima |
| 7,642,901 | B2 | 1/2010 | Kato et al. |
| 7,653,481 | B2 | 1/2010 | Tramel |
| 7,706,796 | B2 | 4/2010 | Rimoni et al. |
| 7,726,360 | B2 | 6/2010 | Sato et al. |
| 7,804,423 | B2 | 9/2010 | Mudalige et al. |
| 7,818,380 | B2 | 10/2010 | Tamura et al. |
| 7,822,380 | B2 | 10/2010 | Wu |
| 7,822,546 | B2 | 10/2010 | Lee |
| 7,826,945 | B2 | 11/2010 | Zhang et al. |
| 7,894,592 | B2 | 2/2011 | Book et al. |
| 7,920,969 | B2 | 4/2011 | Mudalige et al. |
| 8,121,802 | B2 | 2/2012 | Grider et al. |
| 8,145,376 | B2 | 3/2012 | Sherony |
| 8,290,704 | B2 | 10/2012 | Bai |
| 2001/0001847 | A1 | 5/2001 | Hessing |
| 2002/0087262 | A1 | 7/2002 | Bullock et al. |
| 2002/0152018 | A1 | 10/2002 | Duckeck |
| 2003/0028320 | A1 | 2/2003 | Niitsuma |
| 2003/0036848 | A1 | 2/2003 | Sheha et al. |
| 2003/0040866 | A1 | 2/2003 | Kawakami |
| 2003/0040868 | A1 | 2/2003 | Fish et al. |
| 2003/0158652 | A1 | 8/2003 | Friedrichs et al. |
| 2004/0021583 | A1 | 2/2004 | Lau et al. |
| 2004/0117108 | A1 | 6/2004 | Nemeth |
| 2004/0117113 | A1 | 6/2004 | Friedrichs et al. |
| 2005/0085956 | A1 | 4/2005 | Losey |
| 2005/0144573 | A1 | 6/2005 | Moody et al. |
| 2005/0159881 | A1 | 7/2005 | Furukawa |
| 2006/0025923 | A1 | 2/2006 | Dotan et al. |
| 2006/0026335 | A1 | 2/2006 | Hodgson et al. |
| 2006/0069504 | A1 | 3/2006 | Bradley et al. |
| 2006/0089788 | A1 | 4/2006 | Laverty |
| 2006/0145837 | A1 | 7/2006 | Horton et al. |
| 2006/0168627 | A1 | 7/2006 | Zeinstra et al. |
| 2006/0172745 | A1 | 8/2006 | Knowles |
| 2006/0184314 | A1 | 8/2006 | Couckuyt et al. |
| 2006/0190164 | A1 | 8/2006 | Glaza |
| 2006/0241857 | A1 | 10/2006 | Onishi et al. |
| 2006/0282214 | A1 | 12/2006 | Wolterman |
| 2007/0005241 | A1 | 1/2007 | Sumizawa et al. |
| 2007/0038362 | A1 | 2/2007 | Gueziec |
| 2007/0050248 | A1 | 3/2007 | Huang et al. |
| 2007/0093955 | A1 | 4/2007 | Hughes |
| 2007/0104224 | A1 | 5/2007 | Conner et al. |
| 2007/0143013 | A1 | 6/2007 | Breen |
| 2007/0143482 | A1 | 6/2007 | Zancho |
| 2007/0143798 | A1 | 6/2007 | Jira et al. |
| 2007/0198172 | A1 | 8/2007 | Sumizawa et al. |
| 2007/0203643 | A1 | 8/2007 | Ramaswamy et al. |
| 2007/0203646 | A1 | 8/2007 | Diaz et al. |
| 2007/0213092 | A1 | 9/2007 | Geelen |
| 2007/0219706 | A1 | 9/2007 | Sheynblat |
| 2007/0273624 | A1 | 11/2007 | Geelen |
| 2007/0290839 | A1 | 12/2007 | Uyeki et al. |
| 2008/0005734 | A1 | 1/2008 | Poristoin et al. |
| 2008/0065318 | A1 | 3/2008 | Ho |
| 2008/0082260 | A1 | 4/2008 | Kimura |
| 2008/0114534 | A1 | 5/2008 | Yamazaki et al. |
| 2008/0147305 | A1 | 6/2008 | Kawamata et al. |
| 2008/0147308 | A1 | 6/2008 | Howard et al. |
| 2008/0162034 | A1 | 7/2008 | Breen |
| 2008/0195305 | A1 | 8/2008 | Jendbro et al. |
| 2008/0228346 | A1 | 9/2008 | Lucas et al. |
| 2008/0303693 | A1 | 12/2008 | Link, II |
| 2009/0055091 | A1 | 2/2009 | Hines et al. |
| 2009/0063042 | A1 | 3/2009 | Santesson et al. |
| 2009/0083627 | A1 | 3/2009 | Onda et al. |
| 2009/0143934 | A1 | 6/2009 | Motonaga et al. |
| 2009/0177384 | A1 | 7/2009 | Walder |
| 2009/0186596 | A1 | 7/2009 | Kaltsukis |
| 2009/0192688 | A1 | 7/2009 | Padmanabhan et al. |
| 2009/0196294 | A1 | 8/2009 | Black et al. |
| 2009/0216434 | A1 | 8/2009 | Panganiban et al. |
| 2009/0228172 | A1 | 9/2009 | Markyvech et al. |
| 2009/0254266 | A1 | 10/2009 | Altrichter et al. |
| 2009/0259354 | A1 | 10/2009 | Krupadanam et al. |
| 2009/0326797 | A1 | 12/2009 | Tengler et al. |
| 2009/0326801 | A1 | 12/2009 | Johnson et al. |
| 2010/0010732 | A1 | 1/2010 | Hartman |
| 2010/0048184 | A1 | 2/2010 | Kim |
| 2010/0088018 | A1 | 4/2010 | Tsurutome et al. |
| 2010/0088029 | A1 | 4/2010 | Hu et al. |
| 2010/0094500 | A1 | 4/2010 | Jin |
| 2010/0094550 | A1 | 4/2010 | Tsurutome et al. |
| 2010/0138151 | A1 | 6/2010 | Jang et al. |
| 2010/0174485 | A1 | 7/2010 | Taylor et al. |
| 2010/0191463 | A1 | 7/2010 | Berry et al. |
| 2010/0198508 | A1 | 8/2010 | Tang |
| 2010/0217482 | A1 | 8/2010 | Vogel et al. |
| 2010/0241342 | A1 | 9/2010 | Scalf et al. |
| 2010/0245123 | A1 | 9/2010 | Prasad et al. |
| 2011/0003578 | A1 | 1/2011 | Chen et al. |
| 2011/0004523 | A1 | 1/2011 | Giuli et al. |
| 2011/0028118 | A1 | 2/2011 | Thomas |
| 2011/0046883 | A1 | 2/2011 | Ross et al. |
| 2011/0166774 | A1 | 7/2011 | Schunder et al. |
| 2011/0178811 | A1 | 7/2011 | Sheridan |
| 2011/0221586 | A1 | 9/2011 | Eikelenberg et al. |
| 2011/0238289 | A1 | 9/2011 | Lehmann et al. |
| 2011/0246016 | A1 | 10/2011 | Vang et al. |
| 2011/0255481 | A1 | 10/2011 | Sumcad et al. |
| 2012/0004841 | A1 | 1/2012 | Schunder |
| 2012/0029806 | A1 | 2/2012 | Scalf et al. |
| 2012/0029807 | A1 | 2/2012 | Schunder et al. |
| 2012/0041673 | A1 | 2/2012 | Vandivier et al. |
| 2012/0053825 | A1 | 3/2012 | Schunder |

(56) References Cited

U.S. PATENT DOCUMENTS

| | | | |
|---|---|---|---|
| 2012/0173134 | A1 | 7/2012 | Gutman |
| 2013/0030630 | A1 | 1/2013 | Luke et al. |

FOREIGN PATENT DOCUMENTS

| | | |
|---|---|---|
| DE | 102010032229 | 1/2012 |
| EP | 1085299 | 3/2001 |
| JP | 2004021503 | 1/2004 |
| JP | 2005091193 | 4/2005 |
| JP | 20060337180 | 12/2006 |
| JP | 200964951 | 3/2007 |
| JP | 20080078696 | 4/2008 |
| JP | 20080162578 | 7/2008 |
| WO | 2008037471 | 4/2008 |

OTHER PUBLICATIONS

International Searching Authority, The International Search Report and the Written Opinion of the International Searching Authority for the corresponding International Application No. PCT/US2010/23887 mailed Apr. 12, 2010.

Patent Cooperation Treaty, International Preliminary Examining Authority, International Preliminary Report on Patentability for the corresponding PCT/US10/23887 mailed Apr. 29, 2011.

Ford Motor Company, "SYNC with Navigation System," Owner's Guide Supplement, SYNC System Version 1 (Jul. 2007).

Ford Motor Company, "SYNC," Owners's Guide Supplement, SYNC System Version 1 (Nov. 2007).

Ford Motor Company, "SYNC with Navigation System," Owner's Guide Supplement, SYNC System Version 2 (Oct. 2008).

Ford Motor Company, "SYNC," Owner's Guide Supplement, SYNC System Version 2 (Oct. 2008).

Ford Motor Company, "SYNC with Navigation System," Owner's Guide Supplement, SYNC System Version 3 (Jul. 2009).

Ford Motor Company, "SYNC," Owner's Guide Supplement, SYNC System Version 3 (Aug. 2009).

Kermit Whitfield, "A hitchhiker's guide to the telematics ecosystem," Automotive Design & Production, Oct. 2003, http://findarticles.com, pp. 103.

Findlater et al., Impact of Screen Size on Performance, Awareness, and User Satisfaction with Graphical User Interfaces, Association for Computing Machinery (ACM), Apr. 5-10, 2008, pp. 1247-1256, see Fig. 1.

Garmin Garage, Follow the Leader, www.garmin.com/garmin/cms/site/us.

TomTom, portable car navigation systems, http://www.tomtom.com, Feb. 6, 2009.

MapQuest Maps—Driving Directions—Map, http://www.mapquest.com, Aug. 25, 2009.

Multi-Modal Navigation Tools, TDM Encyclopedia, Jan. 26, 2010.

Google Maps Finally Adds Bike Routes, Mary Catherine O'Connor, Mar. 10, 2010, printed from www.wired.com/autopia/2010/03/google-maps-for-bikes/.

POI Along Route Qs, Printed from http://www.tomtomforums.com, printed Jul. 30, 2010.

Difficult POI search in Streets & Trips, printed from http://www.laptopgpsworld.com/3520-difficult-poi-search-streets-tips, printed Jul. 30, 2010.

http://www.rated4stars.com/html/gps-saves-gas.html.

http://www.gps.cx/index.php? c=1&n=493964&i=B001LTHONU&x=GPS_Buddy_FEO1US_Fuel_Economy_Software_Package.

http://www.gpsmagaziine.com/2009/02/hands-on_with_garmins_new_ecor.php (Feb. 2009).

http://www.nrel.gov/vehiclesandfuels/vsa/pdfs/42557.pdf (Apr. 2008).

http://green.autoblog.com/2009/03/05/sentience-research-vehicle-shows-how-tons-of-data-can-save-milli/ (Mar. 2009).

http://reviews.cnet.com18301-13746_7-10189749-48.html.

Navigator—A Talking GPS Receiver for the Blind, Ryszard Kowalik and Stanislaw Kwasniewski, Gdansk University of Technology, 2004.

Speech-Enabled Web Services for Mobile Devices, M. Hu, Z. Davis, S. Prasad, M. Schuricht, P.M. Melilar-Smith and L.E. Moser, Department of Electrical and Computer Engineering, University of California, Santa Barbara, CA 93106, 2013.

METHOD AND APPARATUS FOR CROWD-SOURCED TRAFFIC REPORTING

TECHNICAL FIELD

The illustrative embodiments generally relate to a method and apparatus for crowd-sourced traffic reporting.

BACKGROUND

Many vehicles are provided with in-vehicle notification and/or functionality based on traffic flow and information. This information can be gathered from a variety of sources, with an ever-increased focus on improving the quality and accuracy of the traffic data. Utilizing the gathered information, vehicle navigation systems and other functions can provide improved quality to users and an improved driving experience.

U.S. Pat. No. 7,804,423 generally relates to a system and method for providing real-time traffic information using a wireless vehicle-to-vehicle communications network. A vehicle includes a plurality of sensors that detect other vehicles around the vehicle. The wireless communications system on the vehicle uses the sensor signals to calculate a traffic condition index that identifies traffic information around the vehicle. The vehicle broadcasts the traffic condition index to other vehicles and/or road side infrastructure units that can present the information to the vehicle driver, such as in a navigation system, and/or rebroadcast the traffic information to other vehicles. The traffic condition index can be calculated using the speed of the surrounding vehicles, posted speed limits, the distance between the surrounding vehicles and the traffic density of the surrounding vehicles.

U.S. Pat. No. 8,145,376 generally relates to a system including a road scenario sensor, a vehicle control unit, and a computer processing unit. The road scenario sensor detects upcoming road scenarios for the system vehicle. The computer processing unit receives an input from the road scenario sensor and determines a upcoming driving event based upon the detected upcoming road scenarios. The computer processing unit compares the upcoming driving event with an ideal emissions model having acceptable emission thresholds to determine an adaptive driving strategy. The adaptive driving strategy configures the system vehicle to reduce emissions for the upcoming driving event. The adaptive driving strategy optionally includes an optimal acceleration rate and/or an optimal power management strategy. The optimal acceleration rate is based upon the required speed of the vehicle at the upcoming driving event and the distance from the vehicle to the upcoming driving event, and the ideal emissions model having acceptable emission thresholds.

U.S. Application No. 2009/228172 generally relates to a vehicle-to-vehicle position awareness system that utilizes wireless communication techniques. An embodiment of the system includes a detection and ranging system located on a host vehicle, where the detection and ranging system is configured to sense a neighboring vehicle proximate to the host vehicle. In response to the detection of the neighboring vehicle, the detection and ranging system generates neighboring vehicle data that indicates a position of the neighboring vehicle relative to the host vehicle. The position awareness system also includes a traffic modeler that is configured to process the neighboring vehicle data and, in response thereto, generate a virtual traffic model for the host vehicle. The position awareness system also employs a wireless transmitter that wirelessly transmits host vehicle model data that conveys the virtual traffic model. Compatible vehicles in the vicinity of the host vehicle can receive and process the host vehicle model data to generate their own virtual traffic models

SUMMARY

In a first illustrative embodiment, a system includes a processor configured to project monitoring needs for a road segment. The processor is further configured to contact one or more vehicles traveling on the road segment during a time of monitoring need. The processor is additionally configured to instruct a first number, determined based on a projected monitoring need, of contacted vehicles to being monitoring and reporting traffic data for the road segment.

In a second illustrative embodiment, a system includes a processor configured to receive a vehicle route. The processor is further configured to determine monitoring needs, based on projected traffic volume of road segments, for segments along the vehicle route. The processor is additionally configured to assign the vehicle with a monitoring task when the vehicle reaches certain segments of the route, based on the determined needs.

In a third illustrative embodiment, a computer-implemented method includes projecting monitoring needs for a road segment. The method also includes contacting one or more vehicles traveling on the road segment during a time of monitoring need. The method further includes instructing a first number, determined based on a projected monitoring need, of contacted vehicles to being monitoring and reporting traffic data for the road segment.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
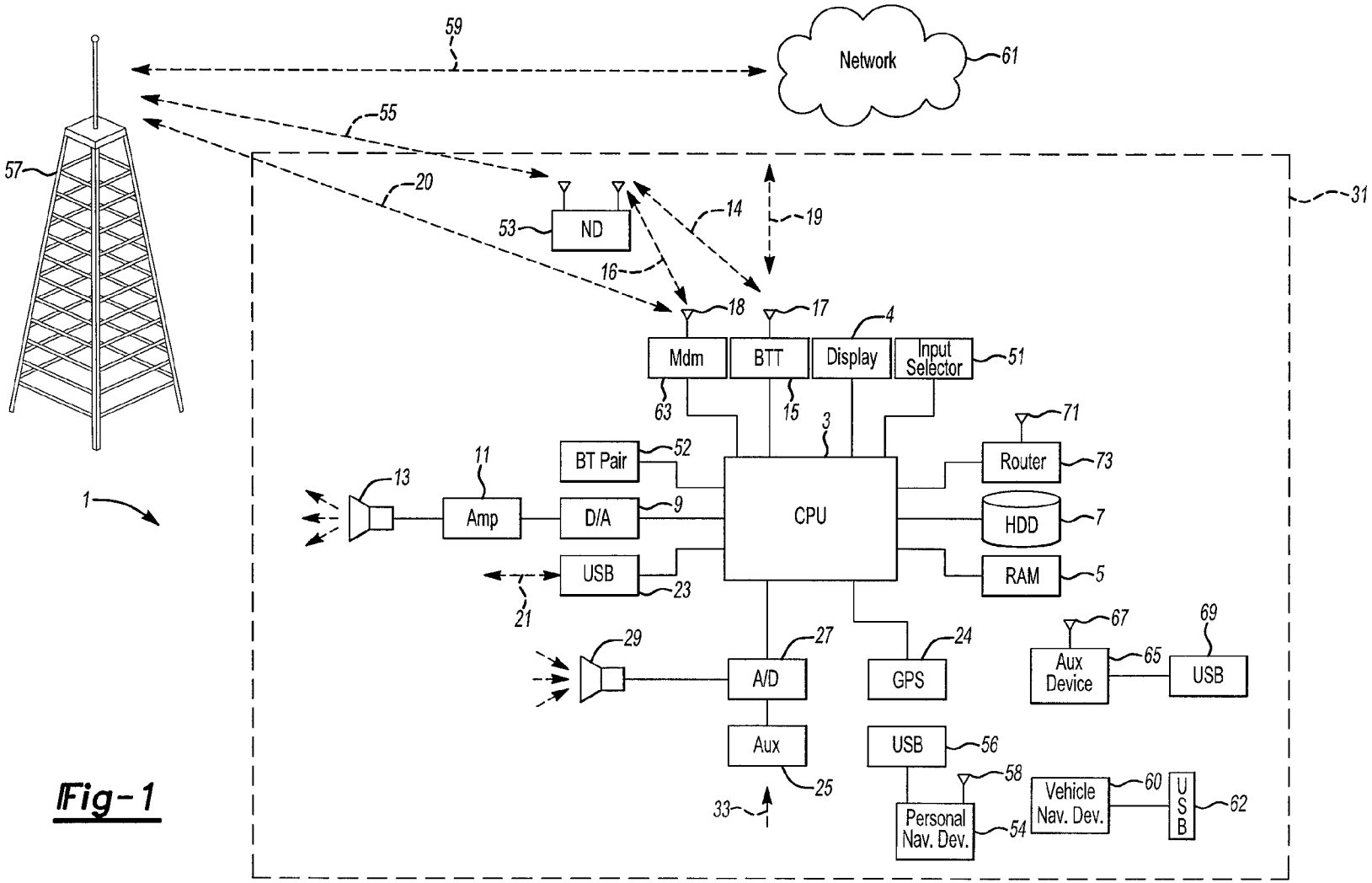
FIG. 1 shows an illustrative vehicle computing system.

FIG. 1 illustrates an example block topology for a vehicle based computing system 1 (VCS) for a vehicle 31. An example of such a vehicle-based computing system 1 is the SYNC system manufactured by THE FORD MOTOR COMPANY. A vehicle enabled with a vehicle-based computing system may contain a visual front end interface 4 located in the vehicle. The user may also be able to interact with the interface if it is provided, for example, with a touch sensitive screen. In another illustrative embodiment, the interaction occurs through, button presses, audible speech and speech synthesis.

In the illustrative embodiment 1 shown in FIG. 1, a processor 3 controls at least some portion of the operation of the vehicle-based computing system. Provided within the vehicle, the processor allows onboard processing of commands and routines. Further, the processor is connected to both non-persistent 5 and persistent storage 7. In this illustrative embodiment, the non-persistent storage is random access memory (RAM) and the persistent storage is a hard disk drive (HDD) or flash memory.

The processor is also provided with a number of different inputs allowing the user to interface with the processor. In this illustrative embodiment, a microphone 29, an auxiliary input 25 (for input 33), a USB input 23, a GPS input 24 and a BLUETOOTH input 15 are all provided. An input selector 51 is also provided, to allow a user to swap between various inputs. Input to both the microphone and the auxiliary connector is converted from analog to digital by a converter 27 before being passed to the processor. Although not shown, numerous of the vehicle components and auxiliary components in communication with the VCS may use a vehicle network (such as, but not limited to, a CAN bus) to pass data to and from the VCS (or components thereof).

Outputs to the system can include, but are not limited to, a visual display 4 and a speaker 13 or stereo system output. The speaker is connected to an amplifier 11 and receives its signal from the processor 3 through a digital-to-analog converter 9. Output can also be made to a remote BLUETOOTH device such as PND 54 or a USB device such as vehicle navigation device 60 along the bi-directional data streams shown at 19 and 21 respectively.

In one illustrative embodiment, the system 1 uses the BLUETOOTH transceiver 15 to communicate 17 with a user's nomadic device 53 (e.g., cell phone, smart phone, PDA, or any other device having wireless remote network connectivity). The nomadic device can then be used to communicate 59 with a network 61 outside the vehicle 31 through, for example, communication 55 with a cellular tower 57. In some embodiments, tower 57 may be a WiFi access point.

Exemplary communication between the nomadic device and the BLUETOOTH transceiver is represented by signal 14.

Pairing a nomadic device 53 and the BLUETOOTH transceiver 15 can be instructed through a button 52 or similar input. Accordingly, the CPU is instructed that the onboard BLUETOOTH transceiver will be paired with a BLUETOOTH transceiver in a nomadic device.

Data may be communicated between CPU 3 and network 61 utilizing, for example, a data-plan, data over voice, or DTMF tones associated with nomadic device 53. Alternatively, it may be desirable to include an onboard modem 63 having antenna 18 in order to communicate 16 data between CPU 3 and network 61 over the voice band. The nomadic device 53 can then be used to communicate 59 with a network 61 outside the vehicle 31 through, for example, communication 55 with a cellular tower 57. In some embodiments, the modem 63 may establish communication 20 with the tower 57 for communicating with network 61. As a non-limiting example, modem 63 may be a USB cellular modem and communication 20 may be cellular communication.

In one illustrative embodiment, the processor is provided with an operating system including an API to communicate with modem application software. The modem application software may access an embedded module or firmware on the BLUETOOTH transceiver to complete wireless communication with a remote BLUETOOTH transceiver (such as that found in a nomadic device). Bluetooth is a subset of the IEEE 802 PAN (personal area network) protocols. IEEE 802 LAN (local area network) protocols include WiFi and have considerable cross-functionality with IEEE 802 PAN. Both are suitable for wireless communication within a vehicle. Another communication means that can be used in this realm is free-space optical communication (such as IrDA) and non-standardized consumer IR protocols.

In another embodiment, nomadic device 53 includes a modem for voice band or broadband data communication. In the data-over-voice embodiment, a technique known as frequency division multiplexing may be implemented when the owner of the nomadic device can talk over the device while data is being transferred. At other times, when the owner is not using the device, the data transfer can use the whole bandwidth (300 Hz to 3.4 kHz in one example). While frequency division multiplexing may be common for analog cellular communication between the vehicle and the internet, and is still used, it has been largely replaced by hybrids of with Code Domian Multiple Access (CDMA), Time Domain Multiple Access (TDMA), Space-Domian Multiple Access (SDMA) for digital cellular communication. These are all ITU IMT-2000 (3G) compliant standards and offer data rates up to 2 mbs for stationary or walking users and 385 kbs for users in a moving vehicle. 3G standards are now being replaced by IMT-Advanced (4G) which offers 100 mbs for users in a vehicle and 1 gbs for stationary users. If the user has a data-plan associated with the nomadic device, it is possible that the data-plan allows for broad-band transmission and the system could use a much wider bandwidth (speeding up data transfer). In still another embodiment, nomadic device 53 is replaced with a cellular communication device (not shown) that is installed to vehicle 31. In yet another embodiment, the ND 53 may be a wireless local area network (LAN) device capable of communication over, for example (and without limitation), an 802.11g network (i.e., WiFi) or a WiMax network.

In one embodiment, incoming data can be passed through the nomadic device via a data-over-voice or data-plan, through the onboard BLUETOOTH transceiver and into the vehicle's internal processor 3. In the case of certain temporary data, for example, the data can be stored on the HDD or other storage media 7 until such time as the data is no longer needed.

Additional sources that may interface with the vehicle include a personal navigation device 54, having, for example, a USB connection 56 and/or an antenna 58, a vehicle navigation device 60 having a USB 62 or other connection, an onboard GPS device 24, or remote navigation system (not shown) having connectivity to network 61. USB is one of a class of serial networking protocols. IEEE 1394 (firewire), EIA (Electronics Industry Association) serial protocols, IEEE 1284 (Centronics Port), S/PDIF (Sony/Philips Digital Interconnect Format) and USB-IF (USB Implementers Forum) form the backbone of the device-device serial standards. Most of the protocols can be implemented for either electrical or optical communication.

Further, the CPU could be in communication with a variety of other auxiliary devices 65. These devices can be connected through a wireless 67 or wired 69 connection. Auxiliary device 65 may include, but are not limited to, personal media players, wireless health devices, portable computers, and the like.

Also, or alternatively, the CPU could be connected to a vehicle based wireless router 73, using for example a WiFi 71 transceiver. This could allow the CPU to connect to remote networks in range of the local router 73.

In addition to having exemplary processes executed by a vehicle computing system located in a vehicle, in certain embodiments, the exemplary processes may be executed by a computing system in communication with a vehicle computing system. Such a system may include, but is not limited to, a wireless device (e.g., and without limitation, a mobile phone) or a remote computing system (e.g., and without limitation, a server) connected through the wireless device. Collectively, such systems may be referred to as vehicle associated computing systems (VACS). In certain embodiments particular components of the VACS may perform particular portions of a process depending on the particular implementation of the system. By way of example and not limitation, if a process has a step of sending or receiving information with a paired wireless device, then it is likely that the wireless device is not performing the process, since the wireless device would not "send and receive" information with itself. One of ordinary skill in the art will understand when it is inappropriate to apply a particular VACS to a given solution. In all solutions, it is contemplated that at least the vehicle computing system (VCS) located within the vehicle itself is capable of performing the exemplary processes.

Real-time information obtained directly from vehicles may enhance the content, accuracy and fidelity of traffic information. An increasing amount of modern vehicles are being equipped with advanced sensing technology, including vision systems, radar and data connectivity systems. Advanced sensor equipped vehicles may be viewed as real-time mobile traffic sensing devices and become a source for information when traversing various roadways. In the illustrative embodiments, repetitive measurements throughout the day are made possible through crowd-sourcing. With direct and continuous (if desired) measurements from a pool of vehicles, the fidelity of traffic information can be greatly improved, bringing performance benefits to other systems. This cooperative learning approach can be applied to estimate the complete schedule of traffic light and other traffic controls as well.

Current systems utilized in traffic information gathering include systems like infrastructure based traffic information. That is, they include sensors, cameras, etc., built directly into existing infrastructure. These systems can be expensive to install and maintain, and are typically, as a result, only installed in areas of common high congestion, if at all. As such, they are not often usable or available to measure traffic congestion on less traveled routes, which may also suffer from traffic. They typically also just provide snapshots of the areas of their purview, as they are not typically continually deployed throughout the road. Using current systems, road congestion is generally inferred from the comparison of observed current vehicle speed and a normal/posted/average daily speed.

Some systems utilize phone presences to determine density estimations of vehicles located around road segments. This information, however may be deficient for a number of reasons, a common of which includes the fact that four phones in a single car will make it seem as if four cars are present at a given location.

Cloud based modules for traffic information sampling may be used to request vehicles to provide traffic information. In terms of total space covered, a sampler's goal can include coverage of the broadest possible area. This may depend on the number of available vehicles capable of providing sensor-based or other information. If there are more than enough vehicles to do so on certain sections of the road, a system may decide to have only a handful to perform sampling, which also can help limit the volume of data transfer.

Age of updated information and the difference between predicted and observed traffic conditions may trigger an increase or decrease of sampling of traffic information for a road segment. The increase in duration between samplings may occur if observed and historical traffic patterns suggest that current traffic conditions are not likely to change for a few moments. A decrease in durations may be associated with fast changing conditions in traffic, either observed or from historical patterns. Using such mechanisms, a balance can be struck between information resolution, sampling frequency and the volume of data transmission and a computational load on the system.

Observed condition on the traffic conditions on connecting segments (on-ramps, off-ramps, interchanges) can be used to examine the possibility of an increase or decrease in traffic on a segment. For example, if a connecting segment is congested, the process may assume that an upcoming (where the segment intersects a new road) segment is going to become or likely to become increasingly congested. Vehicles may also be used to mimic existing traffic sensors, which is to say, each vehicle measures observed traffic conditions as it passes a specific point on the road.

Traffic information fusion integrates information from various sources including vehicles. By combining various sources, a more complete view of the traffic, including average speed, smoothness of traffic flow and traffic density can be obtained. This information can help organize information from a statistical point of view to recognize time dependent and recurrent patterns in the traffic. For example, the average traffic density might be modeled against time where peak hours could be more accurately identified. Crowd-sourced information can also be used to figure out actual traffic schedules to enable advanced energy management systems can help drivers take advantage of reduced fuel consumption through traffic avoidance and limited delays at light intervals (e.g., recommend slowing while a light is red, if slowing will cause the vehicle to reach the light at speed when the light turns green).

The illustrative embodiments can provide high fidelity traffic information with broad and fast coverage of given roads. Light schedules can also be determined through crow-sourced information. With an increasing number of vehicle sensors provided to vehicles, this information can be gathered with growing frequency.

Figure 2:
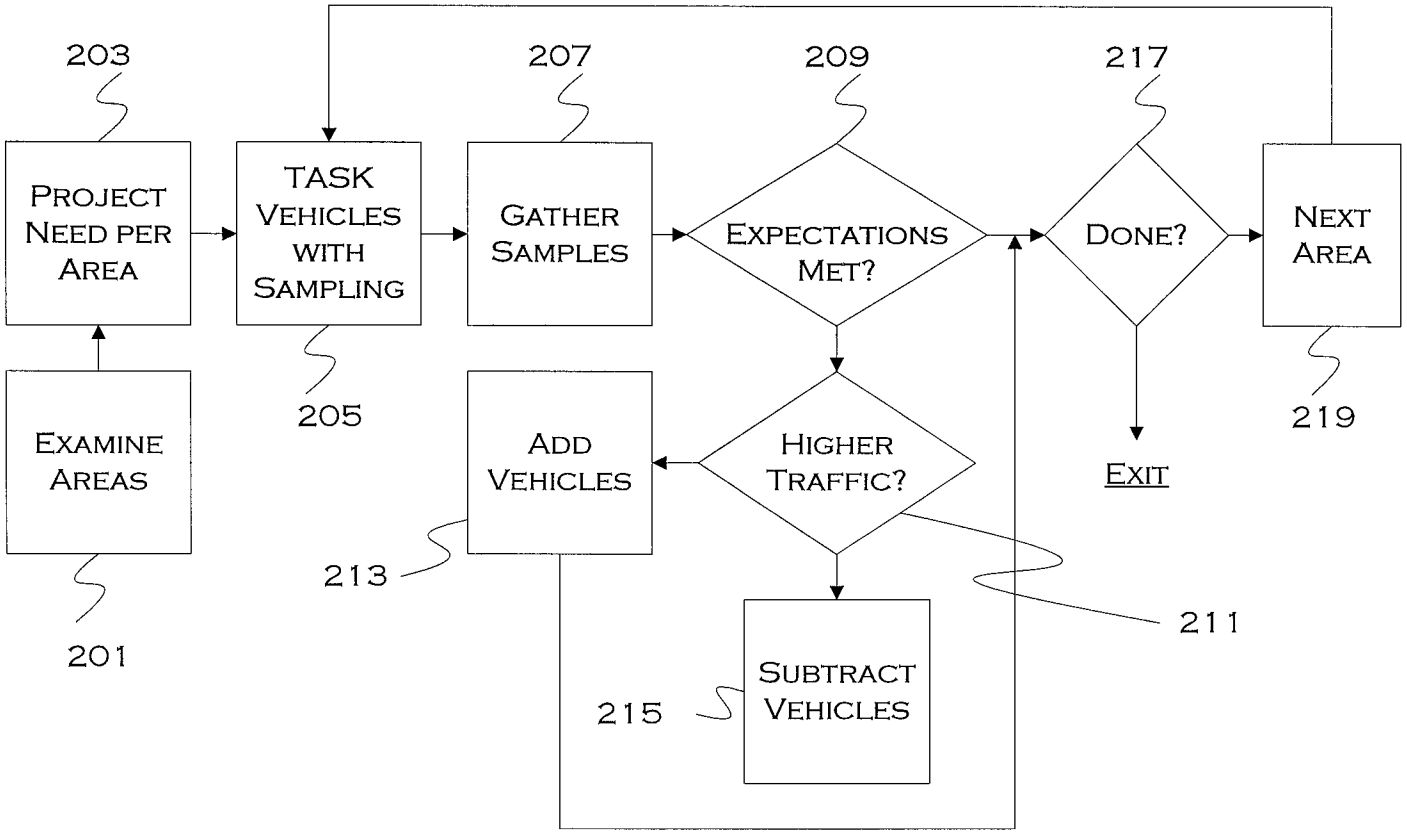
FIG. 2 shows an illustrative process for monitoring management.

FIG. 2 shows an illustrative process for monitoring management. In this illustrative example, the process determines a number of vehicles that should be sampling for a given area, across a number of areas. Vehicles are then tasked with monitoring tasks based on a presence in an area or a projected route passing through an area.

In this example, the process runs on a remote server connected to a number of vehicles through wireless networks. Using such a system, the process can task the vehicles with the job of gathering and reporting information. Traffic information is gathered using a variety of sensors provided to vehicles, such as a radar, cameras and other appropriate sensors and sensing equipment. Vehicle speed monitoring can also be used, as well as frequency of braking/accelerating, switching between braking and accelerating and any other suitable traffic measurement methods.

The process begins by examining areas for which traffic monitoring is desired 201. For each area (or other suitable measurement boundary) the process determines a projected need for monitoring 203. For example, for a segment of a highway, during rush hour, a projected monitoring need may be greater than at 3 AM. For a remote section of highway, while a volume of monitoring may be low, a need may be high, because of an infrequency of travelers on the segment. Most capable vehicles passing through the segment may be used due to low volume of passage. On the other hand, the need may be set to low, because traffic expectations may also be low. Suitable needs can be assigned as they fit various monitoring models.

Once a need is assigned for an area, vehicles within or approaching the area may be tasked with monitoring 205. For example, if 50 monitoring capable vehicles per minute are expected to occupy an area, it may be desirable to task 25 of them with traffic monitoring. Based on changes in total vehicles and speed changes, new vehicles may be added and removed. Currently present vehicles may be assigned to take a snapshot of traffic or monitor for some period of time. Vehicles approaching an area, or which are along a route that passes through the area, may be assigned to provide monitoring when they reach the area. Since information can be continuously received, monitoring parameters and instructions can be dynamically adjusted to fit traffic models.

Once the vehicles are tasked with monitoring, the process gathers samples from the various monitoring vehicles 207. If the expectations for traffic in a given area (based on samples, for example) are not met 209, the volume of monitoring may need to be raised or lowered. For example, if traffic is higher than expected 211, new vehicles may be added 213 to provide increased fidelity of information with respect to more compartmentalized segments. On the other hand, if traffic is lower than expected, vehicles may be removed from monitoring 215 as traffic measurement may be less necessary.

As long as current traffic expectations (based on projections, for example) are met 209, the process checks to see if all current areas have been examined 217. If areas remain for monitoring, the process checks a next area 219.

Figure 3:
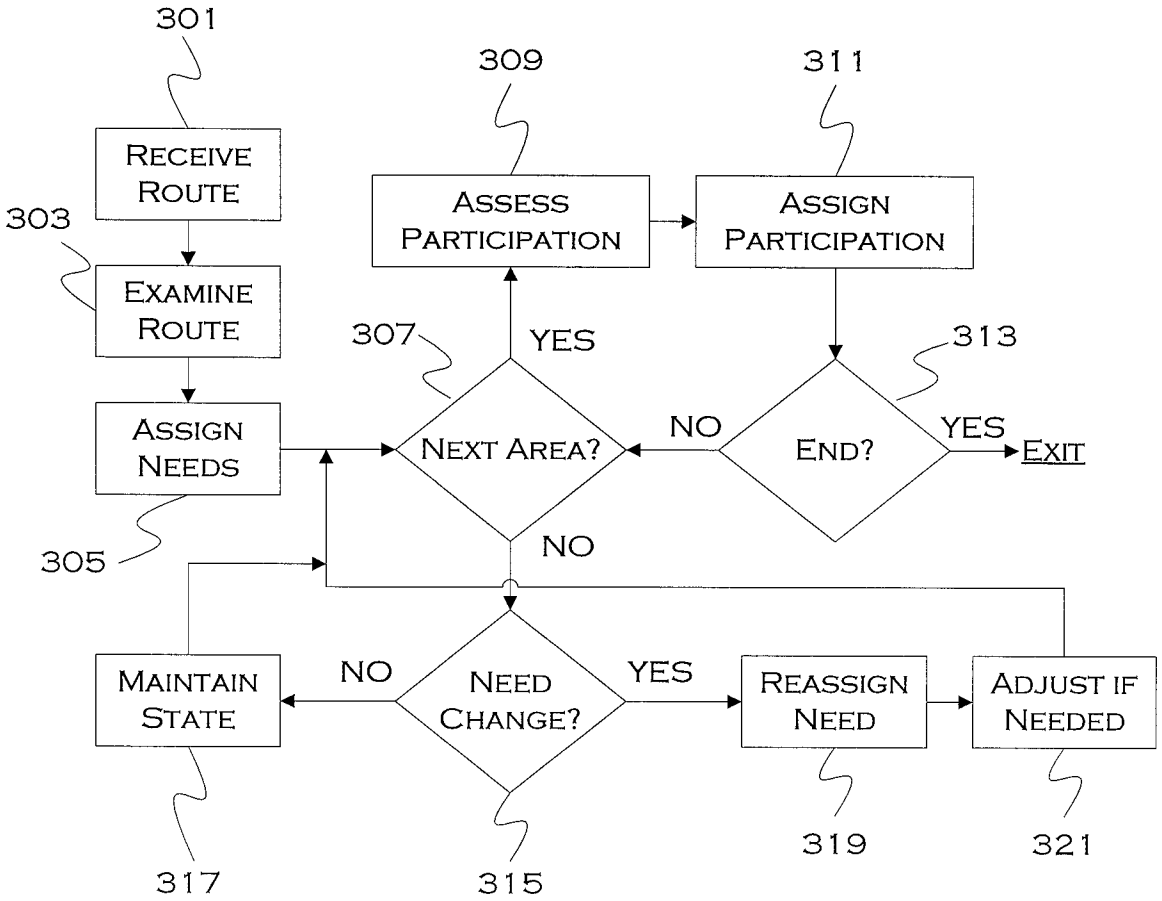
FIG. 3 shows an illustrative process for assigning monitoring to a vehicle.

FIG. 3 shows an illustrative process for assigning monitoring to a vehicle. In this illustrative example, a route from a given vehicle is received 301. This route can be used to assign monitoring instructions to a vehicle so that the vehicle can be instructed to presently or, at some future route point, begin monitoring to provide coverage for a given segment.

In this example, the process examines the vehicle route to see what areas the vehicle is likely to pass through 303. Even for a vehicle without a route, projected travel points can be determined from a current location, and proposed monitoring can be implemented. Monitoring needs are assigned to the vehicle based on a current or next area of travel 305.

The vehicle can then be monitored over the course of a route, based on which area a vehicle is currently located in. If the vehicle is in a next area 307, the process can assess the vehicle participation (i.e., is monitoring assigned or not assigned for that area/segment) 309. Participation can then be assigned if needed 311, based on the present needs of a given area in which the vehicle is present. If the journey has not ended 313, the process continues monitoring.

If the vehicle has not yet changed areas/segments, the process can determine if a need change has occurred for the present area 315. If there is a need change (more or less monitoring), the process can reassign needs for the area 319. This can include adding or removing vehicle monitoring instructions. Also, current monitoring patterns can be adjusted to increase or decrease the volume of monitoring for an area 321. If there is no change in the needs, the process maintains the monitoring state 317 for the vehicle.

Figure 4:
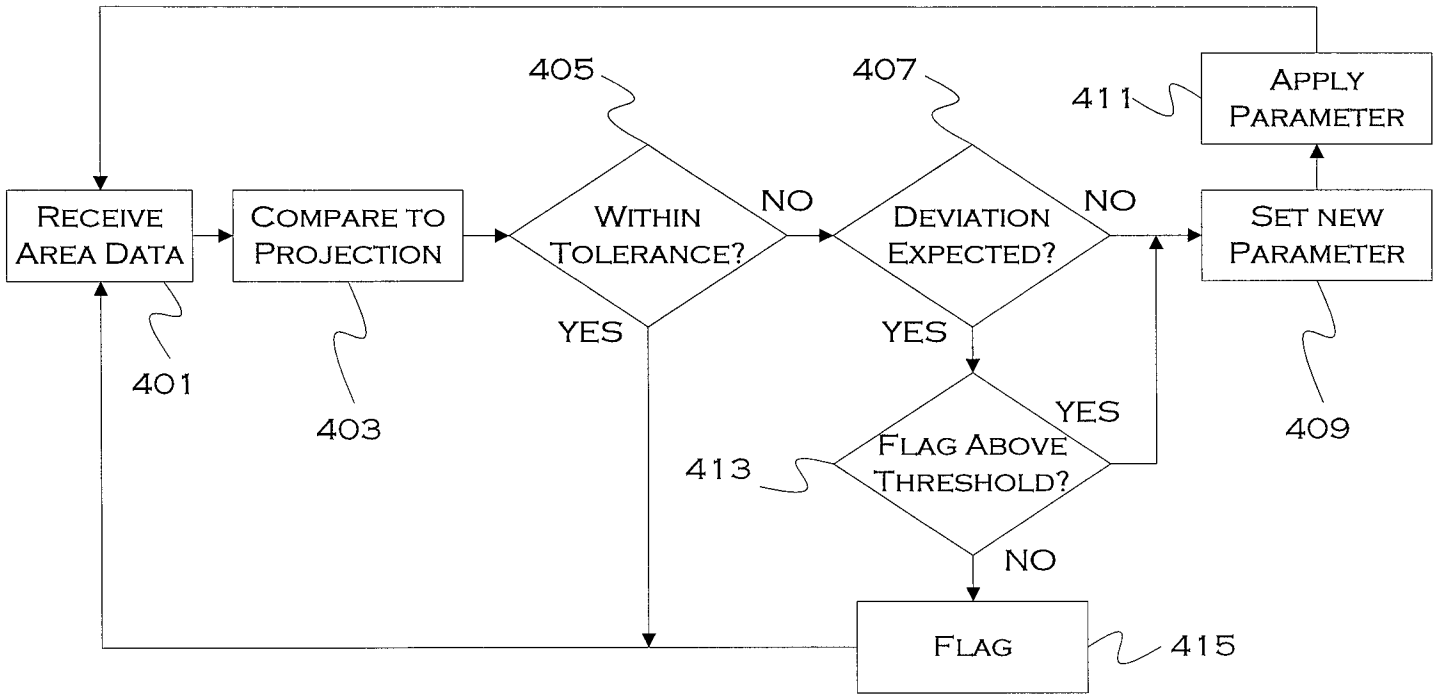
FIG. 4 shows an illustrative process for changing monitoring frequency.

FIG. 4 shows an illustrative process for changing monitoring frequency. In this illustrative example, the process receives data for a given area 401. This includes traffic monitoring data gathered from the vehicles passing through the area. This data can be compared to projected data for the area 403, gathered over time. As more data is gathered, the projections for a given time of day can improve greatly, so projected traffic at times and under given conditions can more accurately represent real traffic on a regular basis.

The current data can be compared to the projected data to determine if current traffic measurements for the segment are within an acceptable tolerance of the projected values 405. If the traffic is within tolerance, there may be no need for adjustment, so the monitoring of the segment can continue. If the actual traffic deviates too much from the projected baseline, the process can check to see if any deviations are expected at that time 407. Deviations may be expected on a limited basis, as even heavy traffic can ebb and flow. A brief deviation may not actually signal a change in overall traffic, so if historical deviations have been observed, one or more deviation flags or variables may be set or incremented 415. If these deviations aggregate above a threshold amount 413, it can be observed that a true deviance in common traffic patterns exists.

If there is a flagged deviance, or if no deviations of the observed magnitude are expected, the process can set a new monitoring parameter for the area 409. This can instruct increased or decreased monitoring. The parameter may then be applied 411, which, in this case, may cause more or fewer vehicles to begin/stop monitoring the traffic patterns for the given segment.

Figure 5:
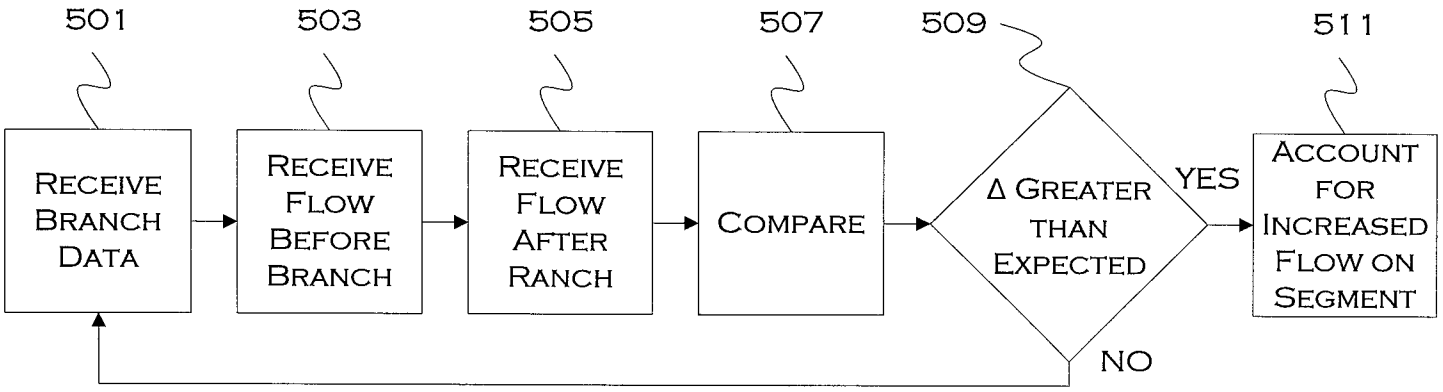
FIG. 5 shows an illustrative process for traffic connector interval monitoring.

FIG. 5 shows an illustrative process for traffic connector interval monitoring. This is a process to determine the flow of traffic on connecting features, such as on-ramps, off-ramps and interchanges. Increased or decreased flow of interchange traffic can indicated a likelihood of increased traffic on a connected road, even if traffic is typically low for that road. For example, if road shutdown occurs, traffic on an interchange may increase significantly for a period of time, before traffic actually backs up on the connected road. This increase can signal a likelihood of increase on the connected road, and pre-emptive increased monitoring for that road segment can be employed. Since the process also checks the segment itself, if the problem never manifests, the system can dynamically adapt to decrease monitoring if not needed.

In this illustrative example, the process receives data for the branch (e.g., on-ramp, off-ramp, interchange, etc.) 501. The process can monitor traffic flow before 503, on and after the branch 505. This traffic can be compared to projected traffic for these areas and for the branch itself 507.

If there is a delta between the observed traffic and the expected values at any of the points observed 509, the process can adjust for projected increased flow on the relevant segment 511. For example, if a great deal of traffic is observed entering an interchange, the road leading to the on-ramp portion of the interchange can be projected to have less traffic, in the same manner that the road following the off-ramp portion can be projected to have an increased flow of traffic.

Figure 6:
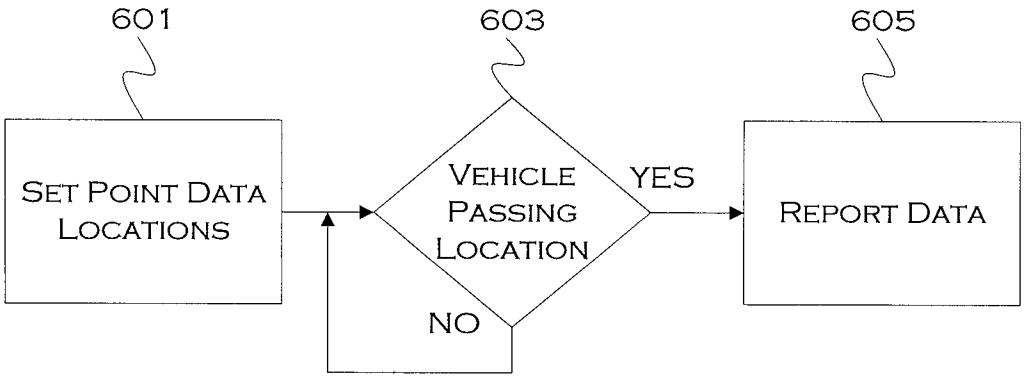
FIG. 6 shows a process for point source monitoring.

FIG. 6 shows a process for point source monitoring. In this illustrative embodiment, the process treats vehicles as proxies for embedded sensors on a route. The process designates a number of points at which traffic should be measured, corresponding to areas of high traffic, times of high traffic, or other appropriate indicia 601. Each vehicle passing the location 603 can then be instructed to report data 605. This causes the vehicles to serve as proxies for the embedded sensors, so that a great deal of point source data can be gathered. This can also be implemented at points such as intersections, so that traffic light patterns and the like can be discovered and refined.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A system comprising:

a processor configured to:

project monitoring needs for a road segment;

contact one or more vehicles traveling on the road segment during a time of monitoring need; and instruct a first number, determined based on a projected monitoring need, of contacted vehicles to being monitoring and reporting traffic data for the road segment.

2. The system of claim 1, wherein the processor is further configured to:

compared received reporting data with projected traffic data for the road segment; and adjust the number of contacted vehicles performing monitoring based on a deviance.

3. The system of claim 2, wherein the volume of contacted vehicles performing monitoring is increased when traffic is greater than expected.

4. The system of claim 2, wherein the volume of contacted vehicles performing monitoring is decreased when traffic is less than expected.

5. The system of claim 1, wherein the processor is further configured to instruct vehicles approaching the road segment to begin monitoring at some point when the vehicles have individually reached the road segment.

6. The system of claim 5, wherein the processor is configured to determine if a vehicle is approaching a road segment based on a known vehicle route, a projected vehicle route, or a current vehicle heading and location.

7. A computer-implemented method comprising:

projecting monitoring needs for a road segment;

contacting one or more vehicles traveling on the road segment during a time of monitoring need; and instructing a first number, determined based on a projected monitoring need, of contacted vehicles to being monitoring and reporting traffic data for the road segment.

8. The method of claim 7, further comprising:

comparing received reporting data with projected traffic data for the road segment; and adjusting the number of contacted vehicles performing monitoring based on a deviance.

9. The method of claim 8, wherein the volume of contacted vehicles performing monitoring is increased when traffic is greater than expected.

10. The method of claim 8, wherein the volume of contacted vehicles performing monitoring is decreased when traffic is less than expected.

11. The method of claim 7, further comprising instructing vehicles approaching the road segment to begin monitoring at some point when the vehicles have individually reached the road segment.

12. The method of claim 7, further comprising determining if a vehicle is approaching a road segment based on a known vehicle route, a projected vehicle route, or a current vehicle heading and location.

* * * * *